US009552935B2

(12) United States Patent
Franc

(10) Patent No.: US 9,552,935 B2
(45) Date of Patent: Jan. 24, 2017

(54) LIMIT SWITCH

(71) Applicant: Schneider Electric Industries SAS, Rueil Malmaison (FR)

(72) Inventor: Aurelien Franc, Marthon (FR)

(73) Assignee: SCHNEIDER ELECTRIC INDUSTRIES SAS, Rueil Malmaison (FR)

( * ) Notice: Subject to any disclaimer, the term of this patent is extended or adjusted under 35 U.S.C. 154(b) by 200 days.

(21) Appl. No.: 14/485,941

(22) Filed: Sep. 15, 2014

(65) Prior Publication Data

US 2015/0096870 A1 Apr. 9, 2015

(30) Foreign Application Priority Data

Oct. 4, 2013 (FR) ..... 13 59616

(51) Int. Cl.
*H01H 3/16* (2006.01)
*H01H 3/46* (2006.01)
(Continued)

(52) U.S. Cl.
CPC ..... *H01H 3/46* (2013.01); *H01H 3/04* (2013.01); *H01H 3/16* (2013.01); *H01H 3/3015* (2013.01);
(Continued)

(58) Field of Classification Search
CPC ..... H01H 11/0006; H01H 1/58; H01H 21/28; H01H 21/285; H01H 3/16
(Continued)

(56) References Cited

U.S. PATENT DOCUMENTS 3,649,785 A * 3/1972 Dietrich ..... H01H 21/285 200/47
3,721,782 A 3/1973 Roumagnac
(Continued)

FOREIGN PATENT DOCUMENTS

DE 10 2010 063 893 A1 6/2012
FR 2 134 814 12/1972

OTHER PUBLICATIONS

French Preliminary Search Report issued Jun. 24, 2014 in French Application 13 59616, filed on Oct. 4, 2013 ( with English Translation of categories of Cited Documents and Written Opinion).

*Primary Examiner* — Renee Luebke
*Assistant Examiner* — Ahmed Saeed
(74) *Attorney, Agent, or Firm* — Oblon, McClelland, Maier & Neustadt, L.L.P.

(57) ABSTRACT

The invention relates to a limit switch comprising:
- a body (1) and a head (2),
- an actuation member (3),
- a shaft (30) that can be actuated in rotation about an axis of rotation (Y) by pivoting of the actuation member (3),
- a plunger (4),
- a cam mechanism for converting the rotational movement of the shaft (30) into a translational movement of the plunger (4) and vice versa, the cam mechanism comprising:
- a first cam (7) and a first cam follower (70), arranged to generate between them a first non-zero rotational torque over a first range of rotation of the shaft (30),
- a second cam (8) and a second cam follower (80), arranged to generate between them a second non-zero rotational torque over a second range of rotation of the shaft.

11 Claims, 5 Drawing Sheets

(51) Int. Cl.

| | |
|---|---|
| ***H01H 3/30*** | (2006.01) |
| ***H01H 3/42*** | (2006.01) |
| ***H01H 21/28*** | (2006.01) |
| ***H01H 3/04*** | (2006.01) |
| ***H01H 3/38*** | (2006.01) |

(52) U.S. Cl.
CPC ..... *H01H 3/38* (2013.01); *H01H 3/42* (2013.01); *H01H 21/28* (2013.01); *H01H 2235/01* (2013.01)

(58) Field of Classification Search
USPC ..... 200/47
See application file for complete search history.

(56) References Cited

U.S. PATENT DOCUMENTS

| | | | | |
|---|---|---|---|---|
| 2013/0047778 | A1* | 2/2013 | Zhou | H01H 21/285 74/526 |
| 2015/0114805 | A1* | 4/2015 | Tsukimori | H01H 3/42 200/47 |
| 2015/0144472 | A1* | 5/2015 | Cevik | H01H 21/22 200/332 |

* cited by examiner

LIMIT SWITCH

TECHNICAL FIELD OF THE INVENTION

The present invention relates to a mechanical limit switch.

STATE OF THE ART

As is known, a mechanical limit switch comprises a body, generally of parallelepipedal form, and a head fixed to the body on a main axis. The switch comprises a switching device and actuation means arranged to cooperate with the switching device. The actuation means comprise an actuation member such as, for example, a lever that can be actuated by pivoting. The movement of an object is detected by mechanical actuation of the actuation member. The actuation means also comprise a shaft driven in rotation by the actuation member about an axis of rotation and a plunger mounted on a spring and intended to control the switching device. A cam mechanism, arranged on the shaft and the plunger, makes it possible to convert the rotational movement of the shaft into a translational movement of the plunger and vice versa.

The patents FR2134814 and U.S. Pat. No. 4,133,991 describe a limit switch as is known from the prior art.

In certain ranges of limit switches, the actuation member is actuated with an amplitude of plus or minus 70° relative to an axial direction. In order to avoid any risk of breaking of the switch, it is necessary to take account of this maximum angle when installing the switch relative to the object whose movement is to be detected. Obviously, it is possible to propose limit switches that have greater rotational amplitudes but this can also prove problematical.

When the actuation member is pivoted by an angle less than 90°, a rotational force is exerted on the cam mechanism, driving the plunger in translation. Then, when the actuation member is released, the latter is pushed back to its rest position by virtue of the cam mechanism on which a return force acts, generated by the spring on the plunger. On the other hand, if the actuation member is pivoted to an angle of approximately 90°, the return force then exhibits a direction situated in the same plane as the axis of rotation of the shaft, then generating no rotational torque allowing for a return of the actuation member to its rest position. The actuation member is then blocked in this position. Solutions to this problem do exist but they are not necessarily satisfactory. One of them consists, for example, in offsetting the bearing point between the plunger and the shaft in order to always retain a rotational torque, even at 90°. This solution requires a greater space. Another solution consists, for example, in employing a torsion spring in place of the compression spring, but this generates an extra cost.

The document DE102013063893 describes a two-cam solution in which each cam is used to activate the plunger on either side of the main axis. Each cam is arranged to act on a distinct side, according to the direction of rotation of the shaft.

The aim of the invention is to propose a limit switch that allows for a rotation of its actuation member to an angle of approximately 90° with no risk of it becoming blocked in this position, the solution of the invention not requiring the use of a torsion spring or the offsetting of the bearing point between the shaft and the plunger.

This aim is achieved by a limit switch comprising:

- a body and a head arranged on a main axis,
- an actuation member fixed to the head and that can be actuated by pivoting in a pivoting plane,

- a shaft that can be actuated in rotation about an axis of rotation by pivoting of the actuation member,
- a plunger mounted on a spring,
- a cam mechanism arranged on the shaft and on the plunger to convert the rotational movement of the shaft into a translational movement of the plunger and vice versa,
- a switching device controlled by the plunger, the cam mechanism comprising:

- a first cam and a first cam follower, arranged to cooperate with one another so as to generate between them a first non-zero rotational torque over a first range of rotation of the shaft, in a direction of rotation of the shaft,
- a second cam and a second cam follower, arranged to cooperate with one another so as to generate between them a second non-zero rotational torque over a second range of rotation of the shaft by continuing the rotation of the shaft in the same direction of rotation.

According to a particular feature, the first rotational torque is zero over the second range of rotation of the shaft.

According to another particular feature, the first cam and the second cam are juxtaposed along the shaft and the first cam follower and the second cam follower are juxtaposed on the plunger.

According to another particular feature, the spring is a compression spring stressing the plunger in translation in an axial direction.

According to another particular feature, the actuation member is a lever or a flexible rod.

According to another particular feature, the head is fixed removably to the body and it can be oriented about the main axis relative to the body.

According to another particular feature, the shaft is housed inside the head.

According to another particular feature, the switching device is housed inside the body.

According to another particular feature, the plunger is arranged between the shaft and the switching device.

According to another particular feature, the pivoting plane of the actuation member is parallel to the main axis and at right angles to the axis of rotation of the shaft.

According to another particular feature, the actuation member can move by pivoting to plus or minus 90° relative to a rest position situated along the main axis.

BRIEF DESCRIPTION OF THE FIGURES

Other features and advantages will emerge from the following detailed description, given with respect to the attached drawings in which.

DETAILED DESCRIPTION OF AT LEAST ONE EMBODIMENT

Figure 1A:
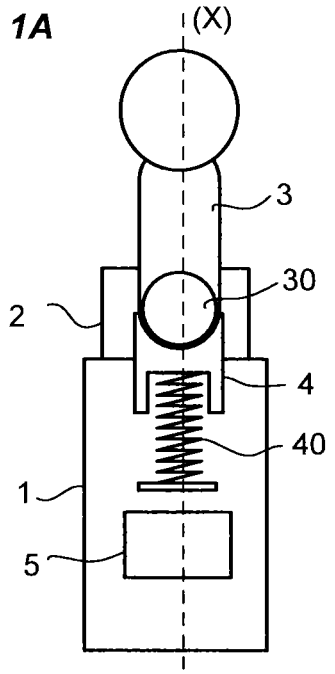
FIGS. 1A to 1C schematically illustrate the principle of operation of a mechanical limit switch.

A mechanical limit switch typically comprises a body 1, generally of parallelepipedal form, and a head 2 fixed to the body. The head is assembled on the body on an axis called main axis (X). As is known, the head 2 is preferentially removable relative to the body 1 so as to be able to assume different orientations about the main axis.

The limit switch comprises an actuation member 3 fixed to the head 2, consisting, for example, of a lever or of a flexible rod, and positioned on the path of the object 6 whose movement is to be detected. This actuation member 3 can move by pivoting. It is fixed to a shaft 30 that can move in rotation about an axis of rotation (Y). Advantageously, this axis of rotation is at right angles to the main axis (X) and situated in the same plane thereof. The shaft 30 is driven in rotation about its axis by the actuation member 3 when the latter is stressed by pivoting. Initially, the actuation member 3 is in a rest position, for example along the main axis (X).

The limit switch also comprises a plunger 4 arranged to cooperate with the shaft 30. This plunger 4 can move in translation in a direction parallel to the main axis (X) and is held against the shaft 30 by a spring 40, preferentially a compression spring. The limit switch comprises a cam mechanism arranged on the plunger 4 and on the shaft 30 to convert the rotational movement of the shaft 30 into a translational movement of the plunger 4 upon an action on the actuation member 3, or to convert the translational movement of the plunger 4 stressed by its spring 40 into a rotational movement of the shaft 30 upon the reaction movement.

The limit switch comprises a switching device 5 controlled by the plunger 4 in translation. An electrical signal is transmitted by the switch when the switching device 5 is in the closed state. Depending on the configuration of the limit switch (normally open or normally closed), the electrical signal will be transmitted when the actuation member 3 is in the rest position or in the actuated position.

Figure 1B:
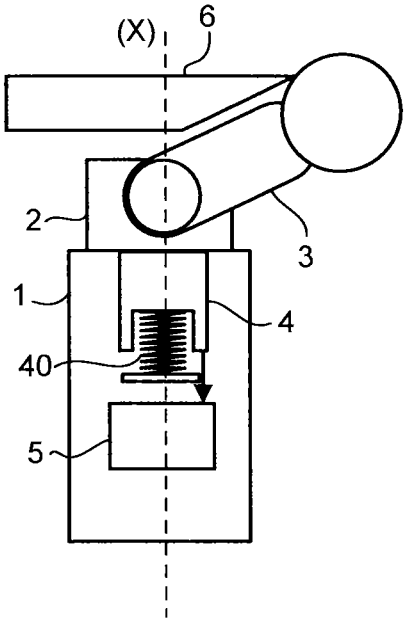
Figure 1C:
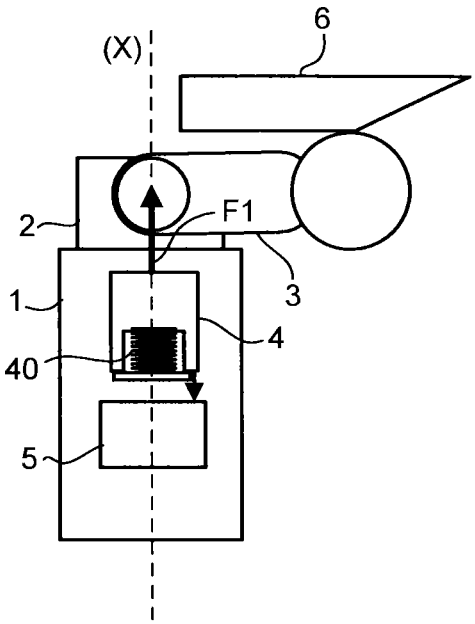

FIGS. 1A to 1C illustrate the principle of operation of a mechanical limit switch.

In FIG. 1A, the actuation member 3 is in the rest position.

In FIG. 1B, the actuation member 3 is actuated by pivoting by the object 6 which is displaced. The pivoting of the actuation member 3 drives a rotation of the shaft 30 about its axis (Y), which, by virtue of the cam mechanism, drives a translation of the plunger 4 against the spring 40. The plunger 4 then acts on the switching device 5. If the stressing of the object 6 onto the actuation member 3 is stopped, the actuation member 3 is pushed back to its rest position by the spring 40 which then acts in reaction mode.

In FIG. 1C, the object 6 has continued its travel driving a pivoting of the actuation member 3 to an angle of 90° relative to its rest position. In this position, the force (F1, FIG. 1C) exerted by the plunger 4 on the shaft 30 lies in one and the same plane (a vertical plane in FIG. 1C) as the axis of rotation (Y) of the shaft 30, thus generating a zero rotational torque which does not allow for a return of the actuation member 3 to its rest position when the object 6 is withdrawn. The result of this is that the actuation member 3 is blocked in this position.

To remedy this problem, the invention consists in producing a cam mechanism which comprises two cams and two distinct cam followers.

Over a first range of rotation of the shaft 30 about its axis (Y), the plunger 4 is driven in translation via a first cam 7 and a first cam follower 70 and over a second range of rotation of the shaft 30 about its axis (Y), the plunger 4 is driven in translation via a second cam 8 and a second cam follower 80.

Advantageously, between 0° and (90°-ϵ), the first cam 7 and the first cam follower 70 generate between them a non-zero rotational torque allowing for a rotation of the shaft 30 about its axis (Y) in both directions of rotation. Between (90°-ϵ) and 90°, the second cam 8 and the second cam follower 80 generate between them a non-zero rotational torque allowing for a rotation of the shaft 30 about its axis (Y) in both directions of rotation.

Figure 4:
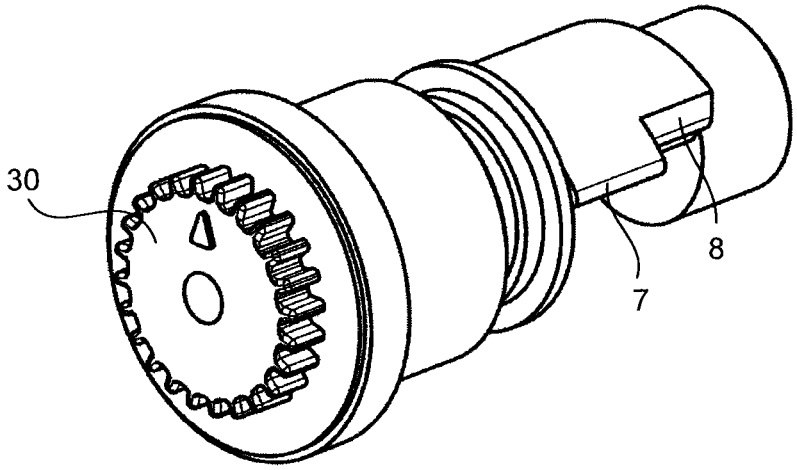
FIG. 4 represents the shaft employed in the mechanical limit switch of the invention.

As represented in FIG. 4, and preferentially, the first cam 7 and the second cam 8 are produced on the shaft 30. They are, for example, juxtaposed thereon along the axis of rotation (Y).

Figure 2:
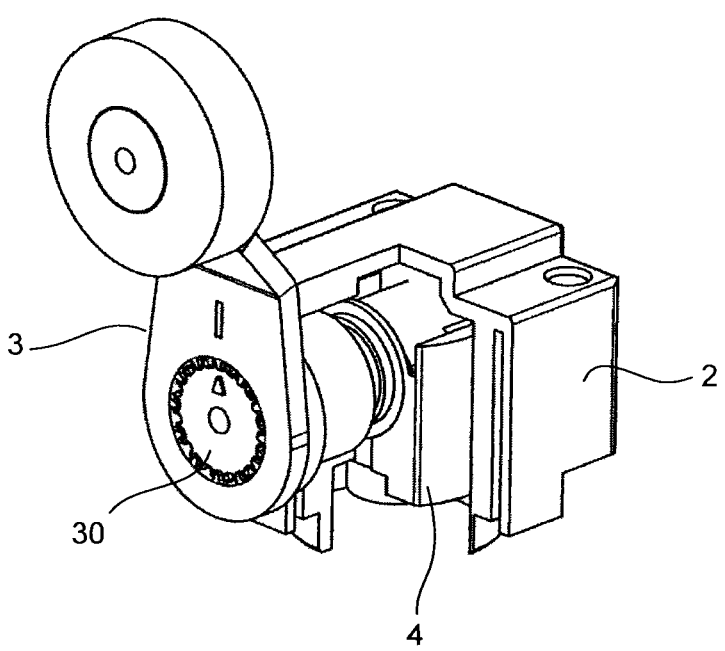
FIG. 2 represents the head of a mechanical limit switch of the invention.
Figure 3:
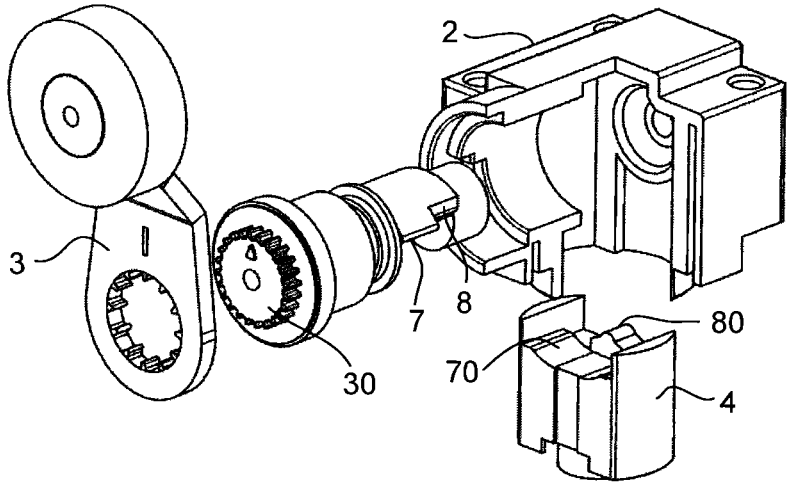
FIG. 3 represents, in an exploded view, the head of a mechanical limit switch of the invention.
Figure 5:
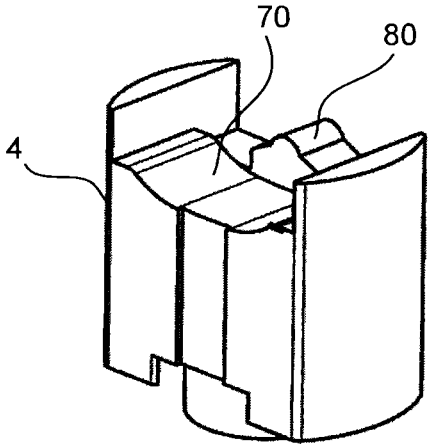
FIG. 5 represents the plunger employed in the mechanical limit switch of the invention.

As represented in FIG. 5, and preferentially, the first cam follower 70 and the second cam follower 80 are produced on the plunger 4. The first cam follower 70 and the second cam follower 80 are juxtaposed on the plunger 4 and are arranged in such a way as to be located facing the first cam 7 and the second cam 8 when the head 2 is assembled (FIGS. 2 and 3).

Figure 6A:
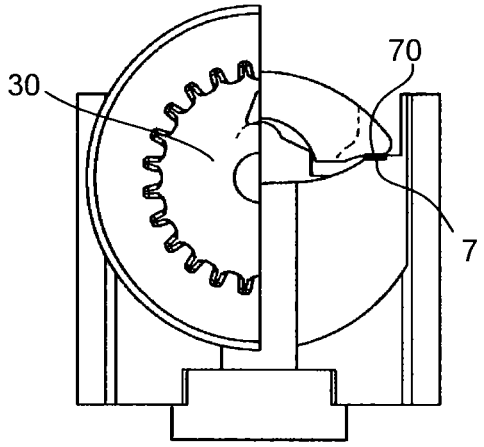
FIGS. 6A and 6B illustrate the principle of operation of the invention.
Figure 6B:
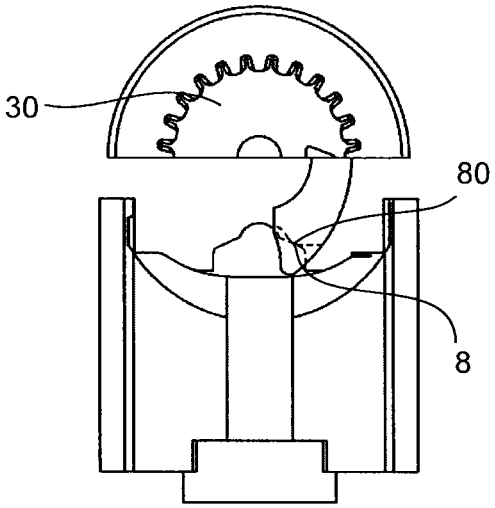

As represented in FIG. 6A, the first cam 7 and the first cam follower 70 are formed in such a way as to retain a non-zero rotational torque over the first range of rotation of the shaft 30, which allows for a return of the actuation member 3 to its rest position over this range of rotation. As represented in FIG. 6B, the second cam 8 and the second cam follower 80 are arranged to retain a non-zero rotational torque between the shaft 30 and the plunger 4 over the second range of rotation, when the rotation of the shaft is continued in the same direction of rotation, beyond the first range of rotation, making it possible to avoid blocking the actuation member 3 even if the latter has been pivoted into the second range of rotation.

Figure 7:
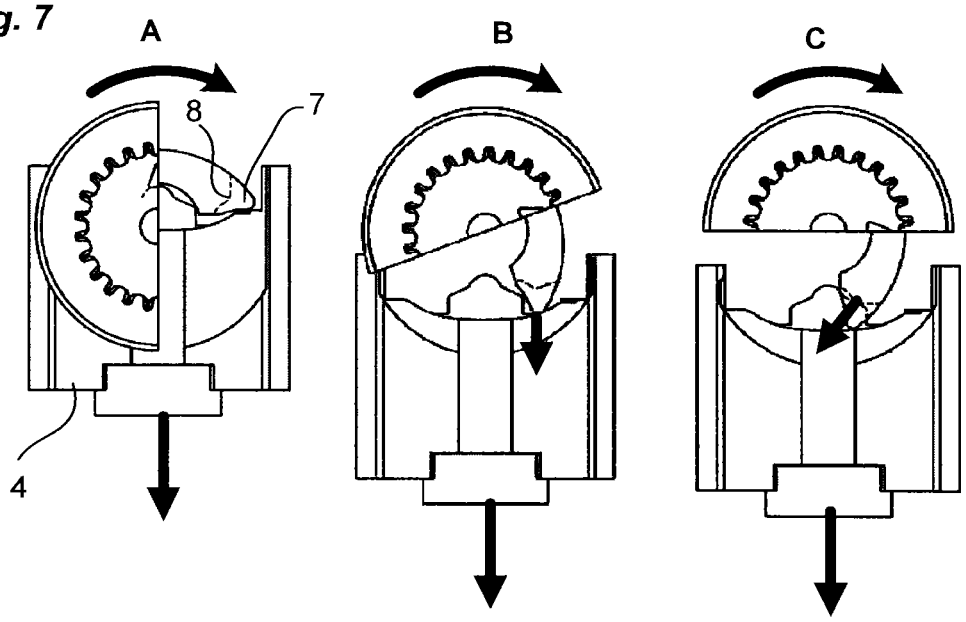
FIGS. 7 and 8 illustrate the principle of operation of the invention, respectively in action mode and in reaction mode.
Figure 8:
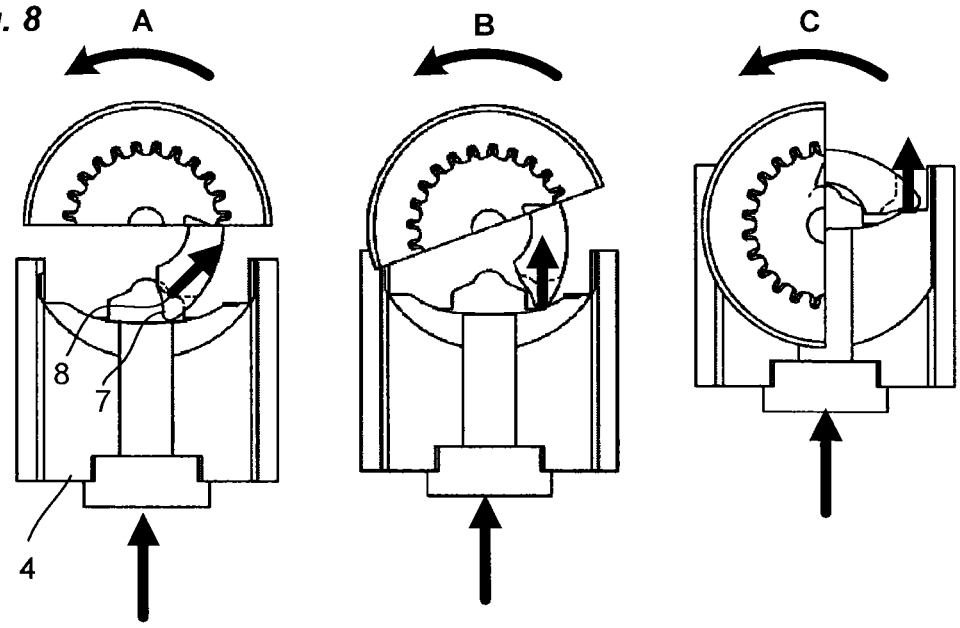

The principle of the invention is better illustrated in FIGS. 7 and 8.

In FIGS. 7A to 7C, the actuation member 3 is stressed in the clockwise direction by the object which is displaced. A stressing in the counter-clockwise direction follows the same principle.

In FIG. 7A, the actuation member 3 is pivoted, in the clockwise direction, over the first range of rotation, driving the shaft 30 about its axis of rotation (Y). Through the intermediary of the first cam 7 which bears on the first cam follower 70, the shaft 30 drives the plunger 4 in translation, which acts on the switching device 5.

In FIG. 7B, at the limit between the first range of rotation and the second range of rotation continuing the rotation in the clockwise direction, the second cam 8 and the second cam follower 80 come into action to maintain a non-zero rotational torque between the shaft 30 and the plunger 4.

In FIG. 7C, the plunger 4 remains stressed by the shaft 30 by virtue of the non-zero rotational torque generated between the second cam 8 and the second cam follower 80.

In FIGS. 8A to 8C, the actuation member 3 is released from any mechanical stress.

In FIG. 8A, the spring 40 pushes the plunger 4 which, through the intermediary of the second cam follower 80 and of the second cam 8, drives a rotation of the shaft 30 in the counter-clockwise direction, the rotational torque being non-zero over this second range of rotation, situated beyond the first range of rotation, in the same direction of rotation of the shaft.

In FIG. 8B, at the limit between the first range of rotation and the second range of rotation, the first cam follower 70 and the first cam 7 maintain a non-zero rotational torque between the shaft 30 and the plunger 4, in order to drive the shaft in rotation in the counter-clockwise direction.

In FIG. 8C, over the first range of rotation, the shaft 30 is stressed in rotation by virtue of the non-zero rotational torque generated between the first cam follower 70 and the first cam 7.

By virtue of a simple and economical solution, the invention thus allows the actuation member of a limit switch to pivot to plus or minus 90° relative to its rest position, without the risk of becoming blocked.

The invention claimed is:

1. A limit switch comprising:

a body and a head arranged on a main axis;

an actuation member fixed to the head and actuatable by pivoting in a pivoting plane;

a shaft actuatable in rotation about an axis of rotation by pivoting of the actuation member;

a plunger mounted on a spring;

a cam mechanism arranged on the shaft and on the plunger to convert the rotational movement of the shaft into a translational movement of the plunger and vice versa; and a switching device controlled by the plunger, wherein the cam mechanism includes a first cam and a first cam follower, arranged to cooperate with one another so as to generate between them a first non-zero rotational torque over a first range of rotation of the shaft in a direction of rotation of the shaft, and a second cam and a second cam follower, arranged to cooperate with one another so as to generate between them a second non-zero rotational torque over a second range of rotation of the shaft, situated beyond the first range of rotation in the same direction of rotation of the shaft, the first cam follower and the second cam follower being juxtaposed on the plunger.

2. The limit switch according to claim 1, wherein the first rotational torque is zero over the second range of rotation of the shaft.

3. The limit switch according to claim 1, wherein the first cam and the second cam are juxtaposed along the shaft.

4. The limit switch according to claim 1, wherein the spring is a compression spring stressing the plunger in translation in an axial direction.

5. The limit switch according to claim 1, wherein the actuation member is a lever or a flexible rod.

6. The limit switch according to claim 1, wherein the head is fixed removably to the body and oriented about the main axis relative to the body.

7. The limit switch according to claim 1, wherein the shaft is housed inside the head.

8. The limit switch according to claim 1, wherein the switching device is housed inside the body.

9. The limit switch according to claim 1, wherein the plunger is arranged between the shaft and the switching device.

10. The limit switch according to claim 1, wherein the pivoting plane of the actuation member is parallel to the main axis and at right angles to the axis of rotation of the shaft.

11. The limit switch according to claim 1, wherein the actuation member is movable by pivoting to plus or minus 90° relative to a rest position situated along the main axis.

* * * * *